United States Patent [19]

Della-Porta

[11] 4,173,917

[45] Nov. 13, 1979

[54] MUSICAL DRUMS

[75] Inventor: Clifford A. Della-Porta, Leicester, England

[73] Assignee: The Premier Drum Company Limited, Leicester, England

[21] Appl. No.: 863,866

[22] Filed: Dec. 20, 1977

[51] Int. Cl.[2] ..... G10D 13/02; G10D 13/04

[52] U.S. Cl. ..... 84/419; 84/411 R; D17/22

[58] Field of Search ..... 84/411 R, 415, 419; D17/22

[56] References Cited

U.S. PATENT DOCUMENTS

| | | | |
|---|---|---|---|
| 1,609,940 | 12/1926 | Geisler | 84/411 R |
| 2,485,985 | 10/1949 | Perry | 84/411 R |
| 3,019,685 | 2/1962 | Davis | 84/411 R |
| 3,435,723 | 4/1969 | Corder | 84/411 R |
| 3,603,194 | 9/1971 | North | 84/411 R |
| 3,674,911 | 7/1972 | Phillips et al. | 84/411 R |
| 3,865,003 | 2/1975 | Della-Porta | 84/411 R |
| 3,911,779 | 10/1975 | Della-Porta | 84/411 R |
| 4,134,324 | 1/1979 | LeMert | 84/411 R |

FOREIGN PATENT DOCUMENTS

| | | | |
|---|---|---|---|
| 1299073 | 12/1972 | United Kingdom | 84/411 R |

*Primary Examiner*—Lawrence R. Franklin

*Attorney, Agent, or Firm*—Spensley, Horn & Lubitz

[57] ABSTRACT

The invention relates to a drum shell for a musical drum, the drum shell comprising at least one portion molded or cast as one piece in natural or synthetic material, so enabling internal and external surfaces of the drum shell to be made in any desired shape.

4 Claims, 8 Drawing Figures

MUSICAL DRUMS

The invention relates to a musical drum.

A conventional musical drum, large or small, has comprised a cylindrical body shell closed at one or both ends by a tensioned head or heads, this body shell generally being made from a sheet of pliable rigid material, for example plywood or thin sheet metal which is rolled into cylindrical form and secured at its butting edges, for example, by welding or cementing.

The construction of a conventional drum therefore invloves a considerable degree of mechanical skill and time, having regard to the precision of finish required in a musical instrument. Moreover the shape of the drum, both internally and externally is very restricted, indeed is almost invariably limited to the purely cylindrical shape.

It is an object of the invention to produce a drum shell having internal and external surfaces of any desired shape, without the necessity of building up the shape in known time-consuming and expensive manner.

In accordance with the present invention, this and other objects are achieved by providing a drum shell for a drum which comprises at least one portion moulded or cast as one-piece from natural or synthetic material.

One suitable natural material is a metal or metal alloy and a suitable synthetic material is plastics such as polyurethane.

The or each said portion may have an inner surface and/or an outer surface of any desired shape. The outer surface may be smooth, patterned or provided with a simulated wood grain effect.

It is to be understood that in relation to a drum shell the term one-piece as used herein does not indicate a drum shell made from a single piece of material such as a rectangular sheet rolled into a cylinder and joined along a vertical seam thereof. A one-piece drum shell is to be regarded as a drum shell which has no joints, seams or the like therein.

Consequently a drum shell may be made up of more than one portion at least one of which is a one-piece portion i.e. having no joints, seams or the like therein, and each portion being joined to other portions to produce a composite drum shell.

Preferably an inner surface of the shell is substantially barrel-shaped. The shell desirably comprises two substantially cylindrical portions each moulded in one-piece, the two portions being joined coaxilly end to end.

The external surface of the shell may be decorated as, for example, by spraying or part spraying with paint or a laquer. Alternatively the external surface may be covered with sheet material. The sheet material may be chosen so as to be purely decorative. Alternatively the sheet material may structurally strengthen the shell, or both decorative and structurally strengthen same. Where a sheet material is used as a covering, a plastics laminate is conveniently used.

As an alternative the shell may comprise a first substantially cylindrical portion and a second bowl-shaped portion a lower circular edge of the first portion being joined to a circular upper edge of the second portion.

As a further alternative the said second portion may be angularly funnel-shaped a lower circular edge of the first portion being joined to a circular upper edge of the second portion.

One or both of the first and second portions may be provided with an aperture in a side wall thereof. Preferably a reflective surface is moulded integrally with an interior surface of the first and/or second portion to divert sound out of the drum shell through the or each aperture.

The shell may be provided with at last one resonator mounted therein.

An exterior surface of the or each portion of the shell may be provided with at least one integrally moulded projection thereon to which drum head tensioning fittings may be secured. The or each said projection is preferably provided at a point spaced from either cylindrical end of the said shell. Due to the provision of the aforementioned projections the said tensioning fittings may be more compact than fitted to conventional drum shells, resulting in a saving of materials, manufacturing costs and finishing costs.

Alternatively at least one part of the tensioning fittings may be moulded integrally with an outer surface of the drum shell.

Above all, moreover, the invention provides for a great flexibility in design.

Thus for instance the shell can be of rounded external shape, convex external shape, or a mixture of such shape. Parts can be of rectilinear section and others rounded and so on. In fact there is no limitation to the forms which the shell can take.

The interior of the shell can be moulded to any suitable shape for example the interior may be bellied to provide a more rounded sound to the ultimate drum.

Although reference has been made above to the moulding of shells of one-piece, it will be appreciated that they could be moulded in separate halves, for example in accordance with U.K. Pat. Specification No. 1,453,041 or in other disparate parts. It will also be appreciated that the moulding of the shell could be adapted for disposal of a resonator in the body, in accordance with U.k. Pat. Specification No. 1,453,902.

Other objects and advantages of the invention will become apparent with reference to the accompanying drawings in which:

FIG. 1 is a schematic sectional view of a one-piece moulded drum shell according to the invention, FIG. 2 is a schematic sectional view of a drum shell according to the invention comprising two one-piece moulded portions, FIG. 3 is a schematic sectional view of a drum shell similar to that shown in FIG. 2, FIG. 4 is a schematic sectional view of a drum shell similar to that shown in FIG. 2, having a resonator therein, FIG. 5 is a schematic sectional view of a kettledrum shell according to the invention, FIG. 6 is a sectional view of a part of a drum shell for use in conjunction with portions of the drum shells shown in FIGS. 2 and 3, FIG. 7 is a schematic sectional view on line X—X of FIG. 8, and FIG. 8 is a plan view of a drum shell according to the invention having an aperture in a lower portion thereof.

FIG. 1 shows a drum shell 2 which is cast or moulded in one-piece. The shell has a barrel shaped internal surfact 4 and attached to a cylindrical outer surface 6 thereof a number of tensioning screw supports 8 (only one of which is shown) provided with a threaded bore 9. The drum whell is intended for use in a double headed drum i.e. one having a head at both top and bottom thereof; accordingly the screw supports 8 are double-ended.

FIG. 2 shows a drum shell similar to that shown in FIG. 1 except that it comprises first and second portions 12, 14 each cast or moulded in one-piece and joined together coaxially end to end. An outer covering 16 is secured to an outer surface of the shell, providing structural strength and a decorative finish. Tensioning fittings for instance tensioning screw supports as shown in FIG. 1 are fitted to the outer surface of the drum shell but these have been omitted for clarity.

FIG. 3 shows a double headed drum shell comprising first and second portions 12*a*, 14*a* and having an internal surface similar to that of the drum shells shown in FIGS. 1 and 2 but having an external surface provided with projections on which are mounted tensioning screw supports 20. It will be noted that since the projections 18 extend to a radius greater than the top or bottom circular edges 22, the supports 20 need only be a fraction of the size needed to obtain the same spacing from the circular top and bottom edges of the tension screw support bores. This results in a saving of materials and manufacturing costs.

Figure 1:
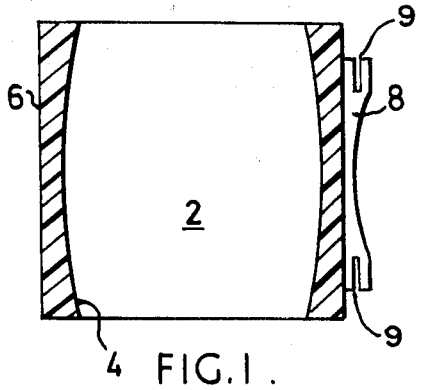
Figure 2:
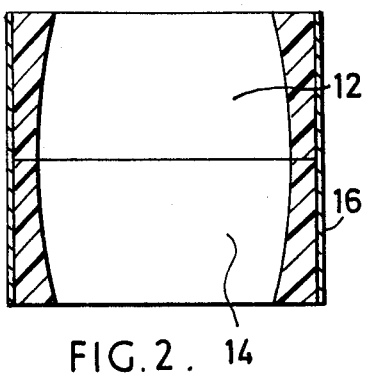
Figure 3:
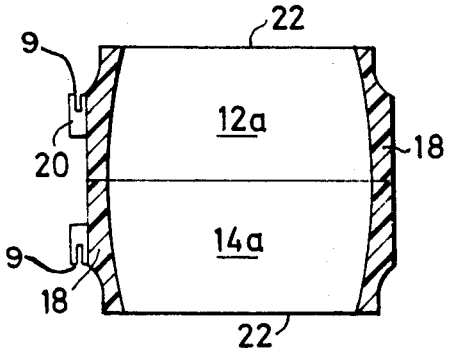
Figure 4:
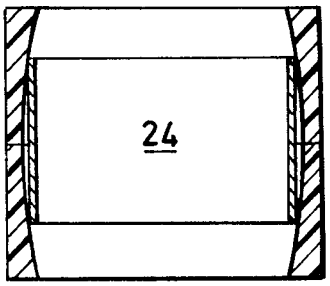
FIG. 4 shows a drum shell similar to that shown in FIG. 2, provided with a resonator 24 therein. The resonator acts to increase reverberation, in a finished drum.
Figure 5:
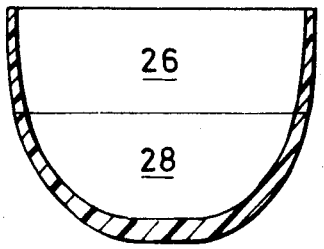
FIG. 5 shows a kettledrum shell according to the invention comprising first and second one-piece portions 26, 28. The kettledrum shell may alternatively be made in a single however.
Figure 6:
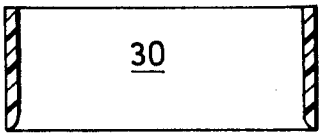

FIG. 6 shows a one-piece drum shell lower portion 30 suitable for use with an upper portion similar to either of the first portion 12, 12*a* of the drum shells shown in FIGS. 2 and 3, to provide a tom-tom drum, with which a lower head is not used.

Figure 7:
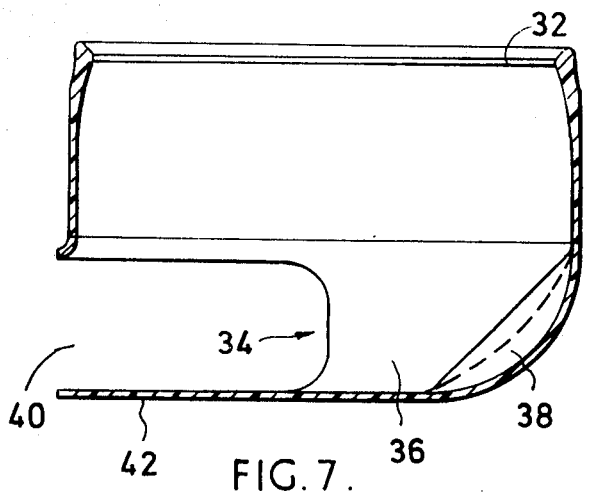
Figure 8:
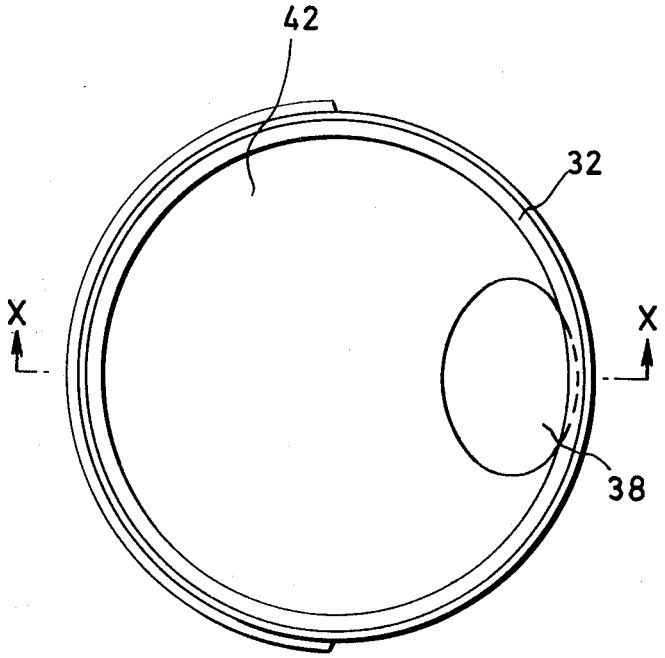

FIGS. 7 and 8 shows a drum shell having a first portion 32 and a second portion 34 both portions being moulded in one-piece. The first portion 32 is similar to The first portion 12*a* of the drum shell shown in FIG. 3. The second portion 34 has a bowl-shaped inside surface 36 provided with an integrally moulded saucer-shaped reflector 38 in one side thereof, an opposite side being provided with an aperture 40 and a projecting lips 42. In use, the reflector 38 reflects sound out through the aperture 42. The saucer-shaped reflector may be replaced by a smooth curved inner surface of the second portion 36.

All the hereinbefore described drum shells may have first portions interchanged one with another to provide composite drum shell structures according to the invention but not illustrated.

The one-piece drum shells described hereinabove are either cast from a metal or a metal alloy or are moulded from a plastics material, typically polyurethane.

Whilst a preferred embodiment of the invention has been described with respect to the drawings it will be apparent to those skilled in the art that various modifications and alterations may be resorted to without deporting further spirit and scope of the invention as defined in the appeaded claims.

Whate is claimed is:

1. A drum shell having a generally cylindrical upper portion and a lower generally bowl-shaped portion, the side wall of said bowl-shaped portion also being generally cylindrical and constituting an integral continuation of said upper portion, the bottom of said bowl-shaped portion being closed, an aperture in the side wall of said bowl-shaped portion, and an integral sound reflector situated within said bowl-shaped portion diametrically opposite said aperture, for directing sound toward said aperture, said reflector intersecting both the side wall and the closed bottom of said bowl-shaped portion.

2. A drum shell as set forth in claim 1 wherein said sound reflector is saucer-shaped and formed integrally with said bowl-shaped portion, and wherein the planar projection of said aperture is generally oblong in shape.

3. A drum shell as set forth in claim 1 wherein said sould reflector comprises a section of said bowl-shaped portion opposite said aperture, said section having a radius of curvature which, when viewed in a vertical plane extending through the center of said reflector and intersecting both the side wall and the closed bottom of said bowl-shaped portion, is greater than the radius of curvature of the remainder of said bowl-shaped portion, thus forming a smooth sound reflector.

4. A drum shell as set forth in claim 1 wherein said upper and lower portions are separable, said upper portion being interchangeably affixable to other bottom portions of different drum types.

* * * * *